US008020851B2

(12) United States Patent
Higaki et al.

(10) Patent No.: US 8,020,851 B2
(45) Date of Patent: Sep. 20, 2011

(54) SHEET SUPPLIER AND IMAGE FORMING APPARATUS INCORPORATING SAME WITH FRICTION AND ELECTROSTATIC SEPARATORS WITH OVERLAPPING PLANES OF PROJECTION

(75) Inventors: Hideto Higaki, Yokohama (JP); Toshifumi Togashi, Zama (JP); Manabu Nonaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/588,749

(22) Filed: Oct. 27, 2009

(65) Prior Publication Data

US 2010/0109227 A1 May 6, 2010

(30) Foreign Application Priority Data

Oct. 31, 2008 (JP) ..... 2008-281901

(51) Int. Cl.
*B65H 3/16* (2006.01)

(52) U.S. Cl. ..... 271/18.1

(58) Field of Classification Search ..... 271/18.1, 271/18.2

See application file for complete search history.

(56) References Cited

U.S. PATENT DOCUMENTS

| | | | | |
|---|---|---|---|---|
| 2,860,874 | A * | 11/1958 | Gulick | 271/18.1 |
| 3,224,757 | A * | 12/1965 | Parke et al. | 271/10.01 |
| 6,824,131 | B2 | 11/2004 | Togashi | |
| 6,948,710 | B2 | 9/2005 | Togashi et al. | |
| 7,418,235 | B2 | 8/2008 | Nonaka et al. | |
| 7,515,866 | B2 | 4/2009 | Togashi et al. | |
| 2002/0036377 | A1 | 3/2002 | Togashi | |
| 2003/0155702 | A1 | 8/2003 | Togashi et al. | |
| 2005/0253323 | A1 | 11/2005 | Fujita et al. | |
| 2006/0181590 | A1 | 8/2006 | Nonaka | |
| 2007/0057429 | A1 | 3/2007 | Watanabe et al. | |
| 2007/0127090 | A1 | 6/2007 | Nonaka | |
| 2009/0035002 | A1 * | 2/2009 | Kushida et al. | 399/53 |

FOREIGN PATENT DOCUMENTS

| | | | |
|---|---|---|---|
| JP | 59203033 A | * | 11/1984 |
| JP | 4-251041 | | 9/1992 |
| JP | 4-350031 | | 12/1992 |
| JP | 2000-085999 | | 3/2000 |
| JP | 2002-211777 | | 7/2002 |

* cited by examiner

*Primary Examiner* — Gerald W McClain
(74) *Attorney, Agent, or Firm* — Harness, Dickey & Pierce, P.L.C.

(57) ABSTRACT

In a sheet separator of a sheet supplier, a friction separator and an electrostatic separator separate an uppermost sheet from other sheets of a plurality of sheets loaded on a sheet tray by a friction force and an attraction force generated by a non-uniform electric field, respectively. A conveyance member is provided downstream from the friction separator and the electrostatic separator in a sheet conveyance direction to feed the uppermost sheet separated by at least one of the friction separator and the electrostatic separator in the sheet conveyance direction. The friction separator and the electrostatic separator are arranged in such a manner that planes of projection of the friction separator and the electrostatic separator overlap or coincide in a direction perpendicular to the sheet conveyance direction in which the conveyance member feeds the uppermost sheet.

8 Claims, 8 Drawing Sheets

SHEET SUPPLIER AND IMAGE FORMING APPARATUS INCORPORATING SAME WITH FRICTION AND ELECTROSTATIC SEPARATORS WITH OVERLAPPING PLANES OF PROJECTION

PRIORITY STATEMENT

The present patent application claims priority from Japanese Patent Application No. 2008-281901, filed on Oct. 31, 2008, in the Japan Patent Office, which is hereby incorporated herein by reference in its entirety.

BACKGROUND OF THE INVENTION

1. Field of the Invention

Example embodiments generally relate to a sheet supplier and an image forming apparatus incorporating the sheet supplier, and more particularly, to a sheet supplier for stably separating and conveying sheets and an image forming apparatus including the sheet supplier.

2. Description of the Related Art

Related-art image forming apparatuses, such as copiers, facsimile machines, printers, or multifunction printers having at least one of copying, printing, scanning, and facsimile functions, typically form an image on a sheet of recording media according to image data. Thus, for example, a sheet supplier loads a plurality of sheets and feeds the plurality of sheets one by one toward an image forming device. The image forming device forms an image on a sheet supplied from the sheet supplier.

The sheet supplier may include a friction member to separate an uppermost sheet from other sheets of the plurality of sheets loaded in the sheet supplier by friction. Specifically, the friction member, made of rubber having a high friction coefficient, pressingly contacts the uppermost sheet to separate the uppermost sheet from other sheets and conveys it as appropriate. One problem with such an arrangement is that the high friction coefficient of the friction member, which is necessary to feed the sheets to the image forming device in a stable manner, may deteriorate over time or according to environmental conditions, degrading feeding performance of the sheet supplier.

Further, when the image forming apparatus is used as a printer, it handles various types of recording media, such as plain paper, coated paper, and label paper. With recording media having a substantially small friction coefficient, sheets providing friction varying depending on temperature, or sheets absorbing moisture and adhering to each other, the friction member of the sheet supplier may not separate the uppermost sheet from other sheets properly.

Alternatively, the sheet supplier may include an endless dielectric belt, a charging member, and a discharging member to attract and separate the uppermost sheet from other sheets. Specifically, the endless dielectric belt is provided above the plurality of sheets loaded in the sheet supplier and moves in a sheet conveyance direction. The charging member applies alternating voltages to a surface of the endless dielectric belt to form an alternating charge pattern. The discharging member discharges the endless dielectric belt. The charge pattern generates an electric field on the endless dielectric belt to generate an attraction force for attracting the uppermost sheet.

However, under certain environmental conditions or due to resistance of the uppermost sheet, the attraction force for attracting the uppermost sheet may not be strong enough to separate the uppermost sheet from other sheets and feed the separated uppermost sheet. Consequently, the uppermost sheet may not be fed toward the image forming device.

Further, the attraction force for attracting the uppermost sheet may also act on other sheets under the uppermost sheet for a certain time period after the endless dielectric belt contacts the uppermost sheet. Consequently, other sheets may be fed simultaneously with the uppermost sheet. To address this, the sheet supplier may wait to separate the uppermost sheet from other sheets until the time period elapses after the endless dielectric belt contacts the uppermost sheet. However, such an expedient means that the sheet supplier cannot separate the uppermost sheet from other sheets quickly. As a result, the image forming apparatus cannot form an image on the uppermost sheet at the high speed required of contemporary image forming apparatuses.

SUMMARY

At least one embodiment may provide a sheet supplier that includes a sheet tray and a sheet separator. The sheet tray loads a plurality of sheets. The sheet separator separates an uppermost sheet from other sheets of the plurality of sheets loaded on the sheet tray, and feeds the separated uppermost sheet.

The sheet separator includes a friction separator, an electrostatic separator, and a conveyance member. The friction separator separates the uppermost sheet from other sheets of the plurality of sheets loaded on the sheet tray by a friction force. The electrostatic separator separates the uppermost sheet from other sheets of the plurality of sheets loaded on the sheet tray by an attraction force generated by a non-uniform electric field. The conveyance member is provided downstream from the friction separator and the electrostatic separator in a sheet conveyance direction to feed the uppermost sheet separated by at least one of the friction separator and the electrostatic separator in the sheet conveyance direction. The friction separator and the electrostatic separator are arranged in such a manner that planes of projection of the friction separator and the electrostatic separator overlap or coincide in a direction perpendicular to the sheet conveyance direction in which the conveyance member feeds the uppermost sheet.

At least one embodiment may provide an image forming apparatus that includes a sheet supplier including a sheet tray and a sheet separator. The sheet tray loads a plurality of sheets. The sheet separator separates an uppermost sheet from other sheets of the plurality of sheets loaded on the sheet tray, and feeds the separated uppermost sheet.

The sheet separator includes a friction separator, an electrostatic separator, and a conveyance member. The friction separator separates the uppermost sheet from other sheets of the plurality of sheets loaded on the sheet tray by a friction force. The electrostatic separator separates the uppermost sheet from other sheets of the plurality of sheets loaded on the sheet tray by an attraction force generated by a non-uniform electric field. The conveyance member is provided downstream from the friction separator and the electrostatic separator in a sheet conveyance direction to feed the uppermost sheet separated by at least one of the friction separator and the electrostatic separator in the sheet conveyance direction. The friction separator and the electrostatic separator are arranged in such a manner that planes of projection of the friction separator and the electrostatic separator overlap or coincide in a direction perpendicular to the sheet conveyance direction in which the conveyance member feeds the uppermost sheet.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
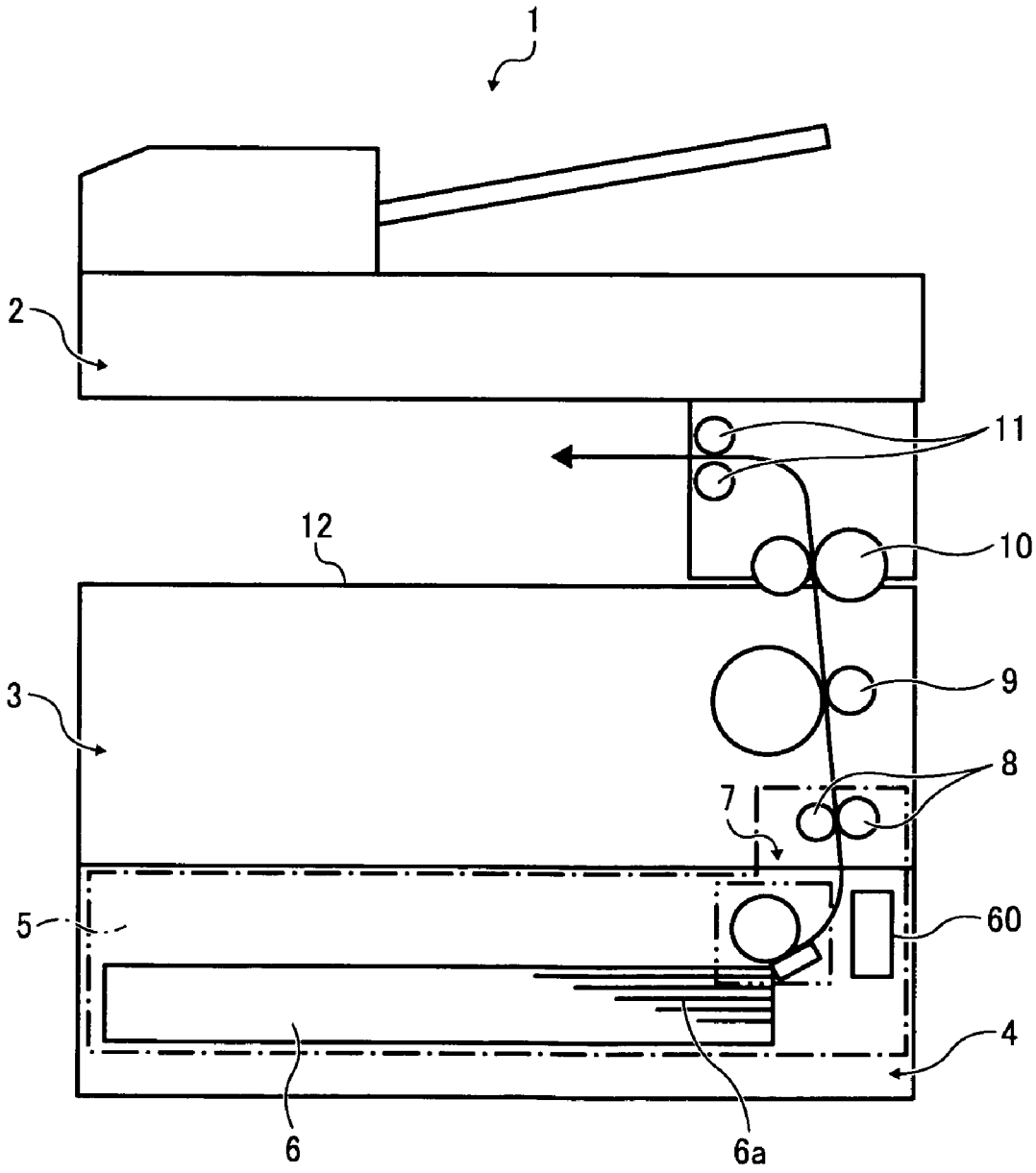
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against; connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 includes an original document reader 2, an image forming device 3, a sheet supply device 4, a transfer device 9, a fixing device 10, an output roller pair 11, an output tray 12, and/or a controller 60.

The sheet supply device 4 includes a sheet supplier 5. The sheet supplier 5 includes a sheet separator 7. The sheet separator 7 includes a conveyance roller pair 8.

As illustrated in FIG. 1, the image forming apparatus 1 may be a copier, a facsimile machine, a printer, a multifunction printer having at least one of copying, printing, scanning, plotter, and facsimile functions, or the like. The image forming apparatus 1 may form an image by an electrophotographic method, an inkjet method, and/or the like. According to this example embodiment of the present invention, the image forming apparatus 1 functions as a copier for forming an image on a recording medium by the electrophotographic method.

The sheet supplier 5 is disposed in the sheet supply device 4. In the sheet supplier 5, the sheet separator 7 contacts an uppermost sheet 6*a* of a plurality of sheets 6 (e.g., a batch of sheets) loaded in the sheet supplier 5 to separate the uppermost sheet 6*a* from other sheets 6 of the plurality of sheets 6. The conveyance roller pair 8, serving as a conveyance member provided in the sheet separator 7, feeds the separated uppermost sheet 6*a* toward the transfer device 9. The image forming device 3 forms a toner image according to image data generated by the original document reader 2 for reading an image on an original document. The transfer device 9 transfers the toner image formed by the image forming device 3 onto the uppermost sheet 6*a*, and feeds the uppermost sheet 6*a* toward the fixing device 10. The fixing device 10 applies heat to the uppermost sheet 6*a* bearing the toner image to fix the toner image on the uppermost sheet 6*a*, and feeds the uppermost sheet 6*a* toward the output roller pair 11. The output roller pair 11 discharges the uppermost sheet 6*a* onto the output tray 12.

According to this example embodiment, the image forming device 3 may be provided separately from the sheet supply device 4 for supplying the uppermost sheet 6*a* to the image forming device 3. The controller 60 controls operations of the image forming apparatus 1.

Figure 2:
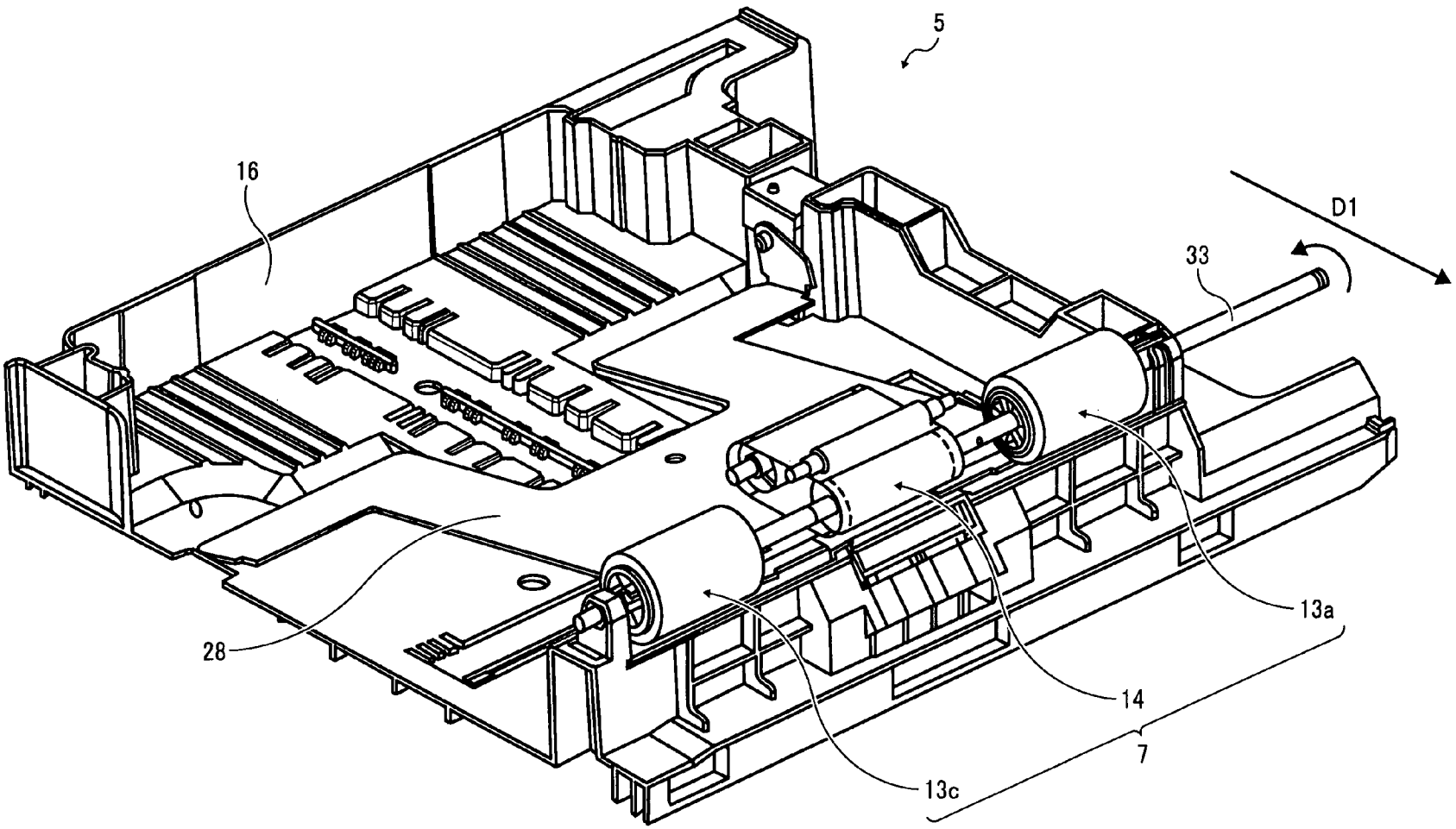
FIG. 2 is a perspective view (according to an example embodiment) of a sheet supplier included in the image forming apparatus shown in FIG. 1.

FIG. 2 is a perspective view of the sheet supplier 5. As illustrated in FIG. 2, the sheet supplier 5 further includes a paper tray 16 and/or a bottom plate 28. The sheet separator 7 further includes friction separators 13*a* and 13*c*, an electrostatic separator 14, and/or a driving shaft 33.

The paper tray 16, serving as a sheet tray, loads the plurality of sheets 6 depicted in FIG. 1. The friction separators 13*a* and 13*c* and the electrostatic separator 14 are arranged in such a manner that planes of projection of the friction separators 13*a* and 13*c* and the electrostatic separator 14 overlap or coincide in a direction perpendicular to a sheet conveyance direction D1 in which the uppermost sheet 6*a* depicted in FIG. 1 separated from other sheets 6 is conveyed. The friction separators 13*a* and 13*c* and the electrostatic separator 14 perform a separation operation for separating the uppermost sheet 6*a* from other sheets 6 simultaneously. In other words, the friction separators 13*a* and 13*c* and the electrostatic separator 14 are arranged in the direction (e.g., a width direction of the uppermost sheet 6*a*) perpendicular to the sheet conveyance direction D1 in such a manner that the friction separators 13*a* and 13*c* and the electrostatic separator 14 are parallel to each other.

The sheet supplier 5 illustrated in FIG. 2 includes the two friction separators 13*a* and 13*c* and the one electrostatic separator 14. However, the numbers of the friction separators 13*a* and 13*c* and the electrostatic separator 14 are not limited to two and one, respectively. For example, the sheet supplier 5 may include one friction separator 13*a* or 13*c* and two electrostatic separators 14. In other words, the sheet supplier 5 includes at least one friction separator 13*a* or 13*c* and at least one electrostatic separator 14.

Figure 3:
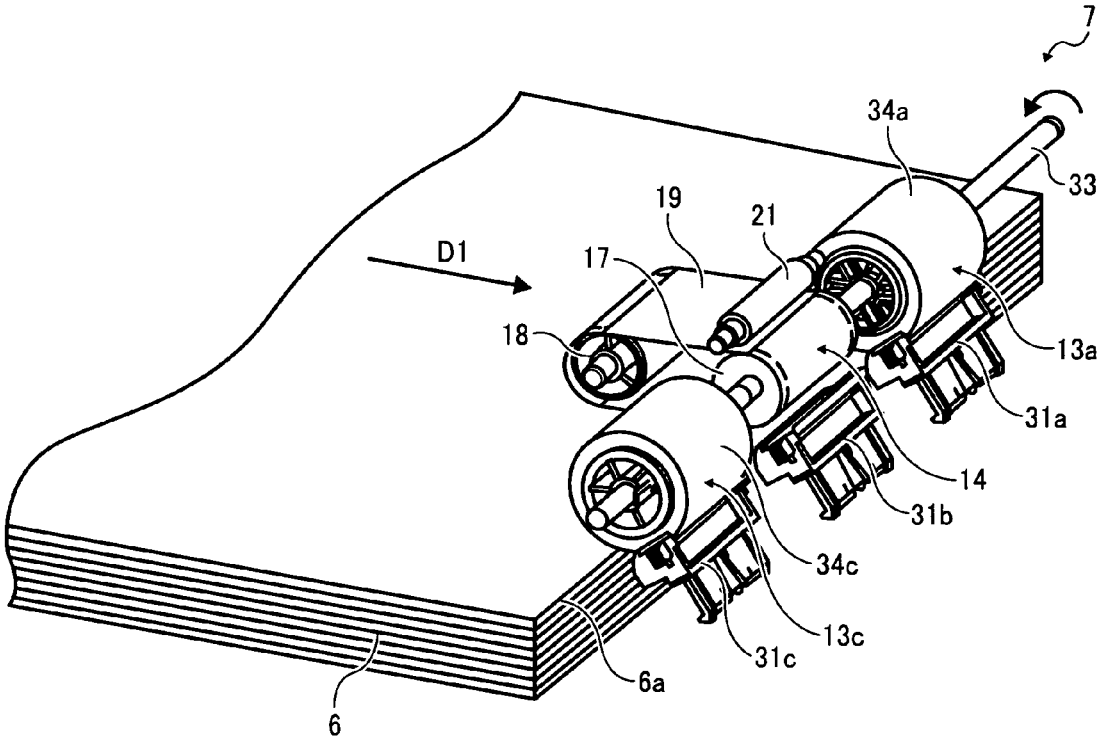
FIG. 3 is a perspective view (according to an example embodiment) of a sheet separator included in the sheet supplier shown in FIG. 2.

FIG. 3 is a perspective view of the sheet separator 7. As illustrated in FIG. 3, the friction separator 13*a* includes a double feeding blocker 31*a* and/or a feed roller 34*a*. The friction separator 13*c* includes a double feeding blocker 31*c* and/or a feed roller 34*c*. The electrostatic separator 14 includes a driving roller 17, a driven roller 18, a belt 19, a charging electrode 21, and/or a double feeding blocker 31*b*.

The friction separators 13*a* and 13*c* separate the uppermost sheet 6*a* from other sheets 6 by using friction difference among the uppermost sheet 6*a*, the feed rollers 34*a* and 34*c*, and the double feeding blockers 31*a* and 31*c*, respectively, in a friction pad separation method. Alternatively, the friction separators 13*a* and 13*c* may use methods other than the friction pad separation method. In other words, the friction separators 13*a* and 13*c* may have any structure capable of feeding back the plurality of sheets 6 other than the uppermost sheet 6*a* to separate the uppermost sheet 6*a* from other sheets 6.

Figure 4:
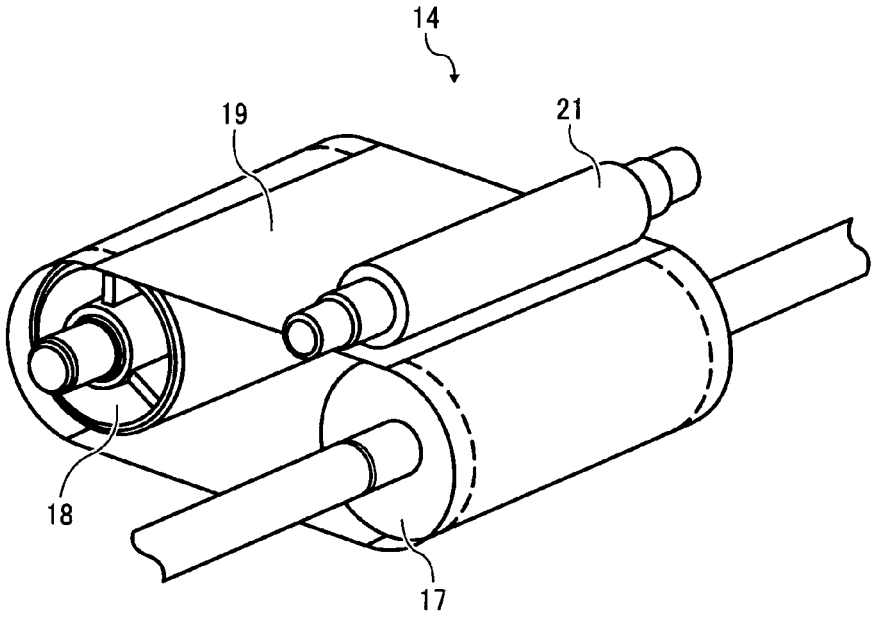
FIG. 4 is a perspective view (according to an example embodiment) of an electrostatic separator included in the sheet separator shown in FIG. 3.

FIG. 4 is a perspective view of the electrostatic separator 14. In the electrostatic separator 14, the endless belt 19 includes a dielectric looped over the driving roller 17 and the driven roller 18. The dielectric of the belt 19 has a resistance not smaller than about $10^8$ Ω·cm. For example, the dielectric of the belt 19 may be a polyethylene terephthalate film having a thickness of about 100 μm. The belt 19 is contacted by the charging electrode 21 having a roller shape and driven by the belt 19.

Figure 5:
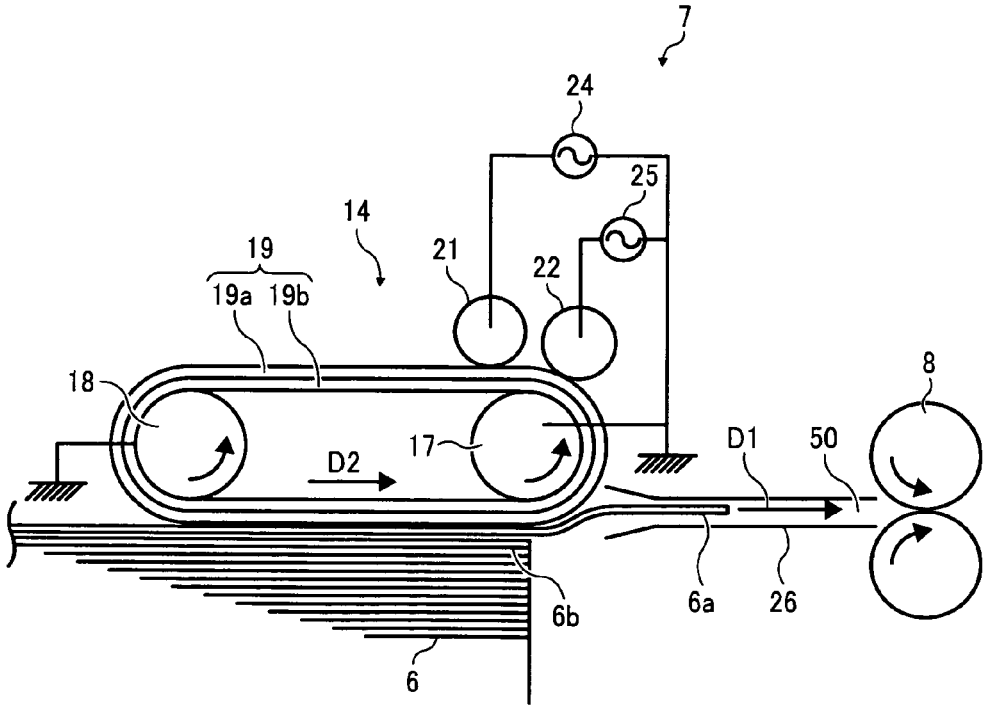
FIG. 5 is a side view (according to an example embodiment) of the sheet separator shown in FIG. 3.

FIG. 5 is a side view of the sheet separator 7. As illustrated in FIG. 5, the sheet separator 7 further includes a guide 26 and/or a conveyance path 50. The electrostatic separator 14 further includes a discharging electrode 22, a charging power source 24, and/or a discharging power source 25. The belt 19 includes a front layer 19*a* and/or a back layer 19*b*.

The belt 19 includes two layers, which are the front layer 19*a* and the back layer 19*b*. The front layer 19*a* includes a dielectric having a resistance not smaller than about $10^8$ Ω·cm. The back layer 19*b* includes a conductor having a resistance not greater than about $10^6$ Ω·cm. The charging electrode 21 uses the back layer 19*b* of the belt 19 as a grounded opposing electrode. Therefore, the charging electrode 21 may contact the front layer 19*a* of the belt 19 at any position on the front layer 19*a* of the belt 19. The plurality of sheets 6 is disposed at a position at which the uppermost sheet 6*a* is attracted by the belt 19 at a sufficient area.

A surface of the driving roller 17 includes a conductive rubber layer having a resistance of about $10^6$ Ω·cm. A surface of the driven roller 18 includes metal. The driving roller 17 and the driven roller 18 are grounded. The driving roller 17 has a small diameter suitable to separate the uppermost sheet 6*a* from the belt 19 by a curvature of the driving roller 17. For example, the great curvature caused by the small diameter of the driving roller 17 separates the uppermost sheet 6*a* attracted by the belt 19 from the belt 19 looped over the driving roller 17, and the belt 19 driven by the driving roller 17 feeds the separated uppermost sheet 6*a* toward the conveyance path 50 formed by the guide 26 provided downstream from the driving roller 17 in the sheet conveyance direction D1.

According to this example embodiment, the charging electrode 21 contacts the belt 19 at a position near a position at which the belt 19 is looped over the driving roller 17. The charging electrode 21 is connected to the charging power source 24 for generating an alternating current. The discharging electrode 22 contacts or is disposed close to the belt 19 at a position upstream from the charging electrode 21 and downstream from a separation position at which the uppermost sheet 6*a* separates from the belt 19 in a rotation direction D2 of the belt 19. The discharging electrode 22 is connected to the discharging power source 25 serving as an alternating power source. The controller 60 depicted in FIG. 1 controls the charging power source 24 and the discharging power source 25 in such a manner that an attraction force of the belt 19 for attracting the uppermost sheet 6*a* is removed from the uppermost sheet 6*a* when a leading edge of the uppermost sheet 6*a* contacts the conveyance roller pair 8. Alternatively, the discharging electrode 22 may be omitted. The following describes operations of the image forming apparatus 1 depicted in FIG. 1 when the discharging electrode 22 is not provided.

Figure 6:
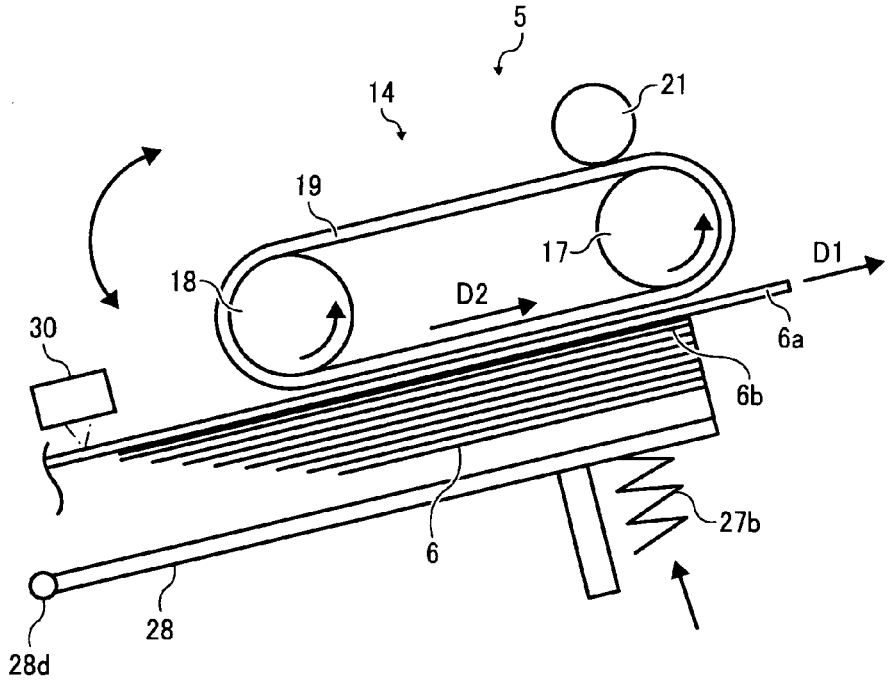
FIG. 6 is a side view (according to an example embodiment) of an example of the sheet supplier shown in FIG. 2.

FIG. 6 is a side view of the sheet supplier 5. As illustrated in FIG. 6, the sheet supplier 5 further includes a push-up member 27*b*, a rotation shaft 28*d*, and/or a sensor 30.

The belt 19 is disposed at a position at which the belt 19, which is looped over the driving roller 17 serving as a rotation shaft of the belt 19 rotating in the rotation direction D2, contacts the leading edge of a front side (e.g., an upper side) of the uppermost sheet 6*a* of the plurality of sheets 6 placed on the bottom plate 28 pushed up by the push-up member 27*b*. The rotation shaft 28*d* is provided at one end of the bottom plate 28 in the sheet conveyance direction D1. When the push-up member 27*b* pushes up another end of the bottom plate 28 opposite to the one end provided with the rotation shaft 28*d* in the sheet conveyance direction D1, the bottom plate 28 rotates about the rotation shaft 28*d* to press the uppermost sheet 6*a* against the belt 19. The belt 19, the driving roller 17, and the driven roller 18 are supported in such a manner that the belt 19, the driving roller 17, and the driven roller 18 move (e.g., tilt) in accordance with movement (e.g., tilt) of the bottom plate 28.

The sensor 30 detects a position of the uppermost sheet 6*a* in a vertical direction. The controller 60 depicted in FIG. 1 controls a gap and a pressure between the belt 19 and the uppermost sheet 6*a* according to a detection result provided by the sensor 30.

Figure 7:
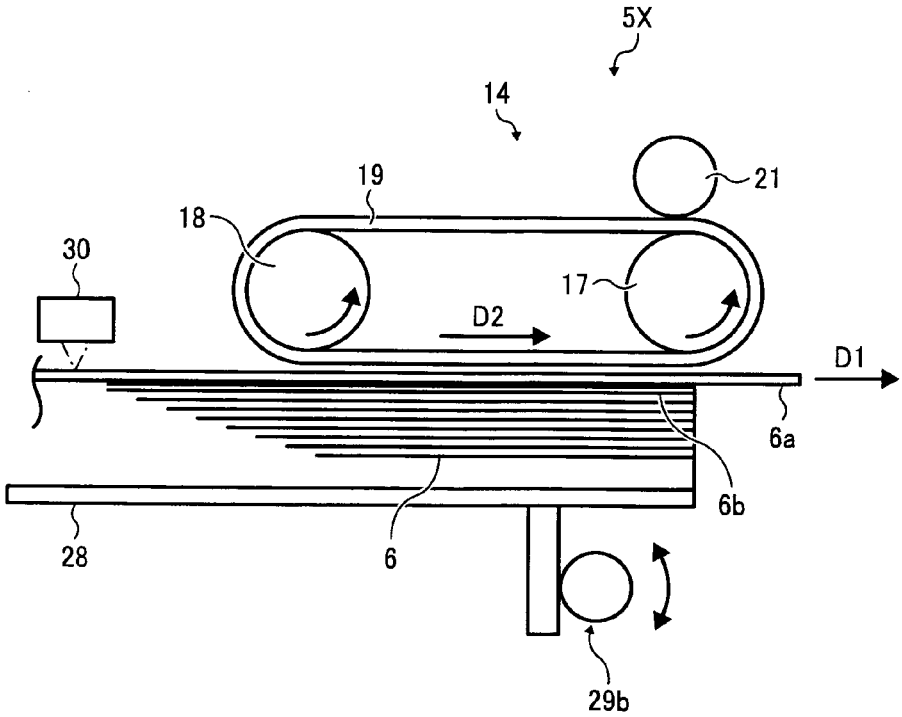
FIG. 7 is a side view (according to an example embodiment) of another example of the sheet supplier shown in FIG. 2.

FIG. 7 is a side view of a sheet supplier 5X. As illustrated in FIG. 7, the sheet supplier 5X includes a push-up member 29*b* replacing the push-up member 27*b* depicted in FIG. 6. The sheet supplier 5X does not include the rotation shaft 28*d* depicted in FIG. 6. The other elements of the sheet supplier 5X are equivalent to the elements of the sheet supplier 5 depicted in FIG. 6.

The push-up member 29*b* including a rack and a pinion lifts and lowers the bottom plate 28 in such a manner that the bottom plate 28 is constantly parallel to a horizontal direction. The belt 19, the driving roller 17, and the driven roller 18 may be fixed in the sheet supplier 5X.

In the sheet suppliers 5 and 5X having the above-described structures, respectively, when a feeding signal turns on an electromagnetic clutch, the electromagnetic clutch rotates the driving roller 17. The charging power source 24 depicted in FIG. 5 applies an alternating voltage via the charging electrode 21 to the belt 19 rotated by the driving roller 17 to form a charge pattern in which pitches in a range from about 4 mm to about 15 mm are alternately provided on a surface of the belt 19 according to a frequency of the charging power source 24 for generating the alternating current and a rotation speed (e.g., a circumferential speed) of the belt 19. Instead of the alternating current, the charging power source 24 may apply a direct current in which high and low potentials are alternately provided. According to this example embodiment, the charging power source 24 applies an alternating current having amplitude of about 4 KV to the surface of the belt 19.

Figure 8A:
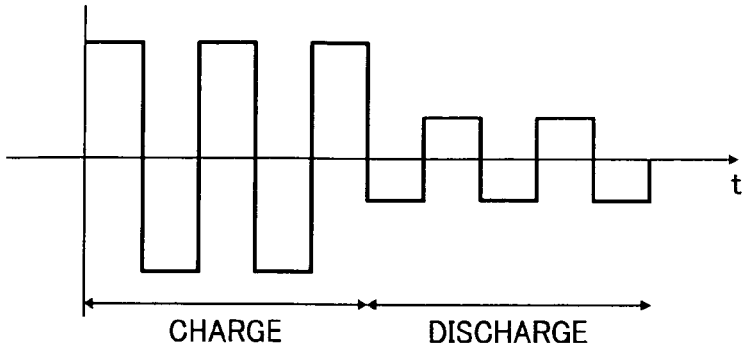
FIG. 8A is a diagram (according to an example embodiment) illustrating square waves for charging and discharging a belt included in the sheet supplier shown in FIG. 6 or 7.

As illustrated in FIG. 8A, a voltage is controller to charge and discharge the belt 19. For example, the voltage applied by the charging power source 24 may be decreased to remove the charge pattern formed on the belt 19.

Figure 8B:
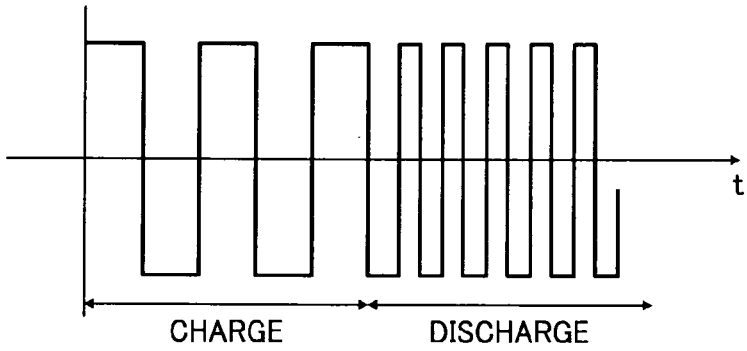
FIG. 8B is another diagram (according to an example embodiment) illustrating square waves for charging and discharging a belt included in the sheet supplier shown in FIG. 6 or 7.
Figure 8C:
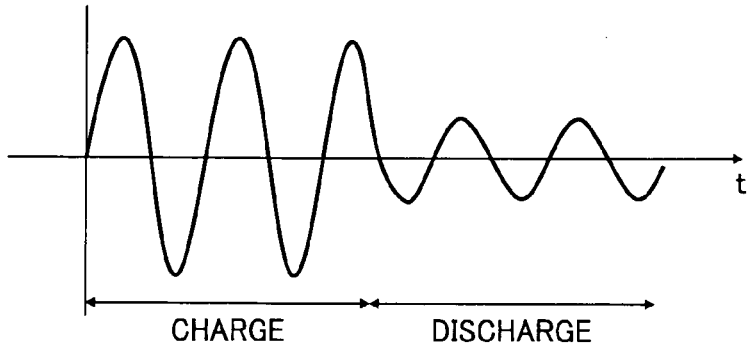
FIG. 8C is a diagram (according to an example embodiment) illustrating sine waves for charging and discharging a belt included in the sheet supplier shown in FIG. 6 or 7.
Figure 8D:
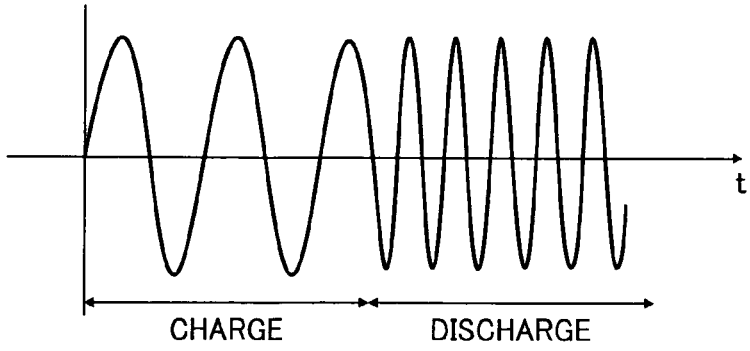
FIG. 8D is another diagram (according to an example embodiment) illustrating sine waves for charging and discharging a belt included in the sheet supplier shown in FIG. 6 or 7.

As illustrated in FIG. 8B, frequency of the charging power source 24 may be increased to shorten the pitches of the charge pattern formed on the belt 19. Thus, the attraction force of the belt 19 for attracting the uppermost sheet 6*a* may be decreased according to the Maxwell stress. FIGS. 8A and 8B illustrate square waves formed by the direct current alternately applied. Similarly, the alternating current may be used. FIGS. 8C and 8D illustrate sine waves formed by the alternating current.

As illustrated in FIG. 5, the belt 19 formed with the charge pattern contacts the leading edge of the front side (e.g., the upper side) of the uppermost sheet 6*a* at a position at which the belt 19 is looped over the driving roller 17. A non-uniform electric field formed by the charge pattern on the surface of the belt 19 applies the Maxwell stress to the dielectric, uppermost sheet 6*a*. Accordingly, the uppermost sheet 6*a* is attracted to the belt 19, and is held and conveyed by the belt 19. Thereafter, the curvature of the driving roller 17 separates the uppermost sheet 6*a* from the belt 19. The uppermost sheet 6*a* is fed in the sheet conveyance direction. D1 toward the conveyance roller pair 8 through the conveyance path 50 formed by the guide 26. The conveyance roller pair 8 feeds the uppermost sheet 6*a* toward the image forming device 3 depicted in FIG. 1.

The attraction force generated by the charge pattern on the belt 19 acts on the uppermost sheet 6*a* as well as sheets 6 other than the uppermost sheet 6*a* for a predetermined time period after the belt 19 attracts the uppermost sheet 6*a*. However, when the predetermined time period elapses, the attraction force acts on the uppermost sheet 6*a* only. Namely, the attraction force does not act on a second sheet 6*b* under the uppermost sheet 6*a* and sheets 6 under the second sheet 6*b*. In other words, even when the electrostatic separator 14 does not include the double feeding blocker 31*b* depicted in FIG. 3, the uppermost sheet 6*a* can be separated from other sheets 6 after the predetermined time period elapses. However, the sheet supplier 5 or 5X may not feed the uppermost sheet 6*a* quickly, resulting in decreased productivity. To address this, the electrostatic separator 14 may include the double feeding blocker 31*b*.

Figure 9:
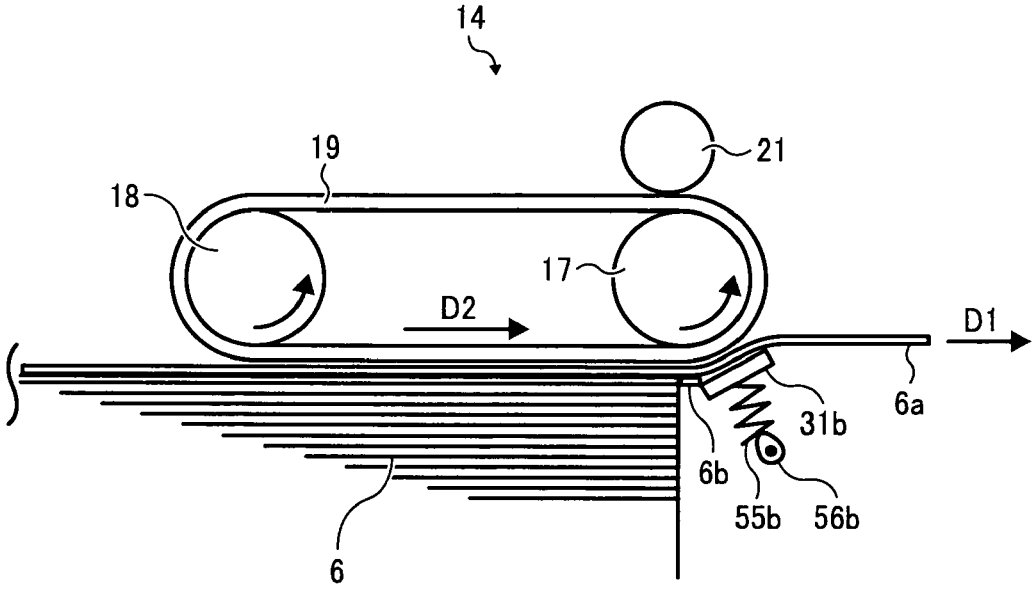
FIG. 9 is a side view (according to an example embodiment) of a pressure applier and a pressure adjuster included in the electrostatic separator shown in FIG. 4.

FIG. 9 is a side view of the electrostatic separator 14. As illustrated in FIG. 9, the electrostatic separator 14 further includes a spring 55*b* and/or an eccentric cam 56*b*.

The spring 55*b*, serving as a pressure applier, presses the double feeding blocker 31*b* against the belt 19. The eccentric cam 56*b*, serving as a pressure adjuster, compresses the spring 55*b*.

The double feeding blocker 31*b* contacts the belt 19 to prevent the second sheet 6*b* from passing though a nip portion formed between the double feeding blocker 31*b* and the belt 19. A linear speed of the conveyance roller pair 8 depicted in FIG. 5 is identical with a linear speed of the belt 19. For example, when the conveyance roller pair 8 is driven intermittently at proper times, the belt 19 is also driven intermittently.

The belt 19 does not attract the next sheet 6*b* before a trailing edge of the uppermost sheet 6*a* reaches an opposing position at which the trailing edge of the uppermost sheet 6*a* opposes the driven roller 18 via the belt 19.

Figure 10:
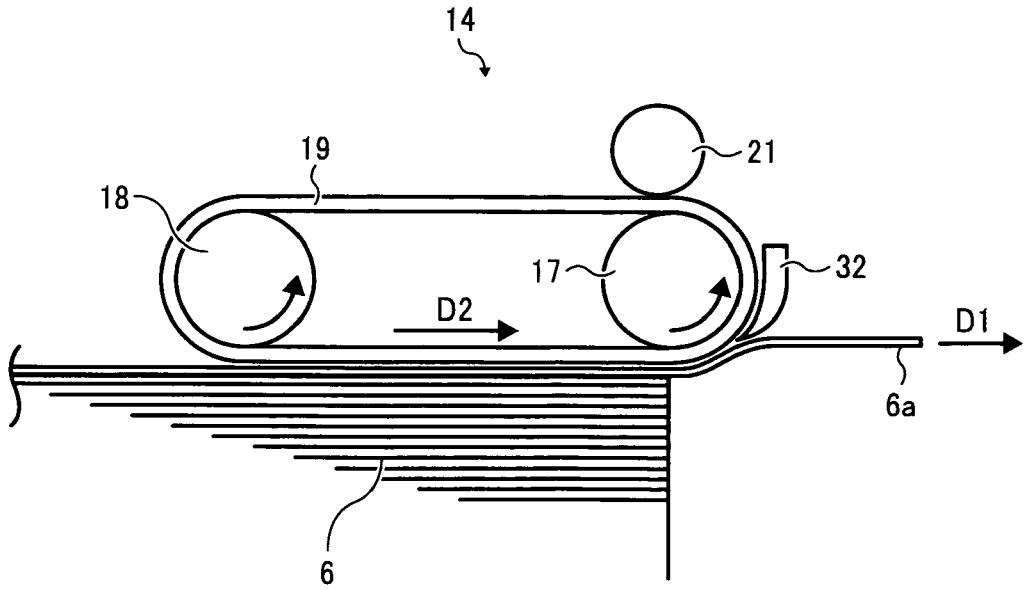
FIG. 10 is a side view (according to an example embodiment) of a separation nail included in the electrostatic separator shown in FIG. 4.

FIG. 10 is a side view of the electrostatic separator 14. As illustrated in FIG. 10, the electrostatic separator 14 further includes a separation nail 32.

The curvature of the driving roller 17 separates the uppermost sheet 6*a* from the belt 19. However, the separation nail 32 may be provided to separate the uppermost sheet 6*a* from the belt 19 more precisely. After the conveyance roller pair 8 depicted in FIG. 5 sandwiches the uppermost sheet 6*a*, the uppermost sheet 6*a* is not affected by the attraction force of the belt 19, and is fed by a conveyance force of the conveyance roller pair 8.

A cleaner removes a foreign substance such as paper dust from the belt 19 to prevent the foreign substance from degrading attraction operations of the electrostatic separator 14.

As described above, according to this example embodiment, the charging electrode 21 having a roller shape applies electric charge to the belt 19 to generate an electric field on the belt 19. Alternatively, the charging electrode 21 may be a plate (e.g., a metal plate or a resin plate) or a brush, which contacts the belt 19 to apply electric charge to the belt 19. Yet alternatively, the charging electrode 21 may be a saw-toothed electrode separated from the belt 19 in such a manner that a slight gap is provided between the belt 19 and the saw-toothed electrode.

Figure 11:
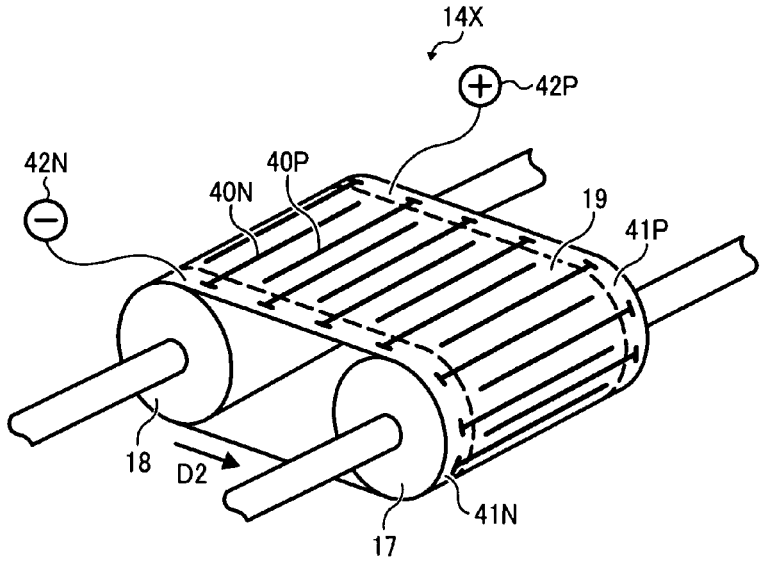
FIG. 11 is a perspective view of an electrostatic separator according to another example embodiment.

FIG. 11 is a perspective view of an electrostatic separator 14X according to another example embodiment. As illustrated in FIG. 11, the electrostatic separator 14X includes the driving roller 17, the driven roller 18, the belt 19, a positive electrode 40P, a negative electrode 40N, a positive voltage receiver 41P, a negative voltage receiver 41N, a high-voltage positive power source 42P, and/or a high-voltage negative power source 42N.

The comb-toothed, positive electrode 40P and the comb-toothed, negative electrode 40N are arranged on the belt 19 in such a manner that the positive electrode 40P opposes the negative electrode 40N in a direction perpendicular to the rotation direction D2 of the belt 19. The positive voltage receiver 41P and the negative voltage receiver 41N are provided on both ends of the belt 19, respectively, in the direction perpendicular to the rotation direction D2 of the belt 19, and expose patterns, respectively. The high-voltage positive power source 42P applies a positive voltage to the positive electrode 40P via the positive voltage receiver 41P. Similarly, the high-voltage negative power source 42N applies a negative voltage to the negative electrode 40N via the negative voltage receiver 41N. Accordingly, an electric field generates on the belt 19, and the belt 19 applies an attraction force to the uppermost sheet 6*a* to attract the uppermost sheet 6*a*.

A clutch is provided between the driving shaft 33 depicted in FIG. 2 and a driver. When the uppermost sheet 6*a* reaches the conveyance roller pair 8 depicted in FIG. 5, the clutch interrupts transmission of a driving force from the driver to driving shaft 33. Accordingly, the driving shaft 33 rotates freely. In other words, the clutch decreases load applied by the driver to the sheet separator 7 depicted in FIG. 2 and the uppermost sheet 6*a*.

As illustrated in FIG. 3, the belt 19 of the electrostatic separator 14 is charged or discharged while the belt 19 rotates. Accordingly, the feed rollers 34*a* and 34*c* of the friction separators 13*a* and 13*c*, respectively, may rotate in accordance with rotation of the belt 19. Consequently, the uppermost sheet 6*a* pushed up by the bottom plate 28 depicted in FIG. 2 and contacted by the feed rollers 34*a* and 34*c* may move and generate failure. To address this, an electromagnetic clutch or the like is provided between the feed rollers 34*a* and 34*c* and the driving shaft 33 to control transmission of a driving force and interruption of the driving force.

When the feed rollers 34*a* and 34*c* of the friction separators 13*a* and 13*c*, respectively, rotate at a circumferential speed different from a circumferential speed of the driving roller 17 of the electrostatic separator 14, the uppermost sheet 6*a* is fed at linear speeds varying in a main scanning direction. Accordingly, the uppermost sheet 6*a* may be skewed, creased, or torn. To address this, the feed rollers 34*a* and 34*c* of the friction separators 13*a* and 13*c*, respectively, and the belt 19 of the electrostatic separator 14 need to move at an identical linear speed. For example, when a single driver drives the feed rollers 34*a* and 34*c* and the belt 19, the feed rollers 34*a* and 34*c* and the belt 19 need to have an identical diameter to rotate at an identical linear speed. Alternatively, the linear speed of the feed rollers 34*a* and 34*c* or the belt 19 needs to be decreased.

The following describes how to control the friction separators 13*a* and 13*c* and the electrostatic separator 14. An attraction-separation method used by the electrostatic separator 14 to attract the uppermost sheet 6*a* and separate the uppermost sheet 6*a* from the next sheet 6*b* may provide problems. For example, when the uppermost sheet 6*a* has a high electric resistance, a substantial time period may be needed to obtain an attraction force needed to attract the uppermost sheet 6*a*. Also, a substantial time period may be needed to decrease the attraction force acting on the next sheet 6*b* and the sheets 6 under the next sheet 6*b*. When the uppermost sheet 6*a* has a low electric resistance, the attraction force may decrease.

On the other hand, a friction-separation method used by the friction separators 13*a* and 13*c* to separate the uppermost sheet 6*a* from the next sheet 6*b* by friction may provide problems. For example, when the uppermost sheet 6*a* has a small friction coefficient or when the uppermost sheet 6*a* is attracted by the next sheet 6*b* strongly, the uppermost sheet 6*a* may not be fed properly or may be fed with the next sheet 6*b*. Namely, the friction separators 13*a* and 13*c* and the electrostatic separator 14 have different drawbacks, respectively. To address this, the friction separators 13*a* and 13*c* and the electrostatic separator 14 operate on the uppermost sheet 6*a* simultaneously to separate the uppermost sheet 6*a* from the next sheet 6*b* stably and precisely to correspond to various environmental conditions or various materials of the uppermost sheet 6*a*.

A thermohygrometer may be provided in the sheet supplier 5 depicted in FIG. 2 or the sheet supplier 5X depicted in FIG. 7 to detect environmental conditions. A user may operate a control panel provided in the image forming apparatus 1 depicted in FIG. 1 to input or select information about a material of the uppermost sheet 6*a*.

In the sheet supplier 5 or 5X depicted in FIG. 6 or 7, respectively, according to this example embodiment, the electrostatic separator 14 does not generate an attraction force when the belt 19 is not charged. Accordingly, when the friction separators 13*a* and 13*c* depicted in FIG. 3 are used without charging the belt 19, the sheet supplier 5 or 5X can provide the friction-separation method without providing the attraction-separation method.

As illustrated in FIG. 3, the friction separators 13*a* and 13*c* and the electrostatic separator 14 are applied with different feeding pressures to press the uppermost sheet 6*a* against the feed rollers 34*a* and 34*c* and the belt 19, respectively. The electrostatic separator 14 attracts the uppermost sheet 6*a* with an electrostatic force. Therefore, in the electrostatic separator 14, the uppermost sheet 6*a* may not be pressed against the belt 19. Accordingly, the electrostatic separator 14 may be applied with the feeding pressure capable of moving the uppermost sheet 6*a* close to the belt 19. On the other hand, in the friction separators 13*a* and 13*c*, the feeding pressure applied to the uppermost sheet 6*a* and the feed rollers 34*a* and 34*c* generates a friction force to feed the uppermost sheet 6*a*. Therefore, a certain level of the feeding pressure needs to be applied to the friction separators 13*a* and 13*c*. Accordingly, separate bottom plates may be provided for the electrostatic separator 14 and the friction separators 13*a* and 13*c*, respectively, as illustrated in FIG. 12.

Figure 12:
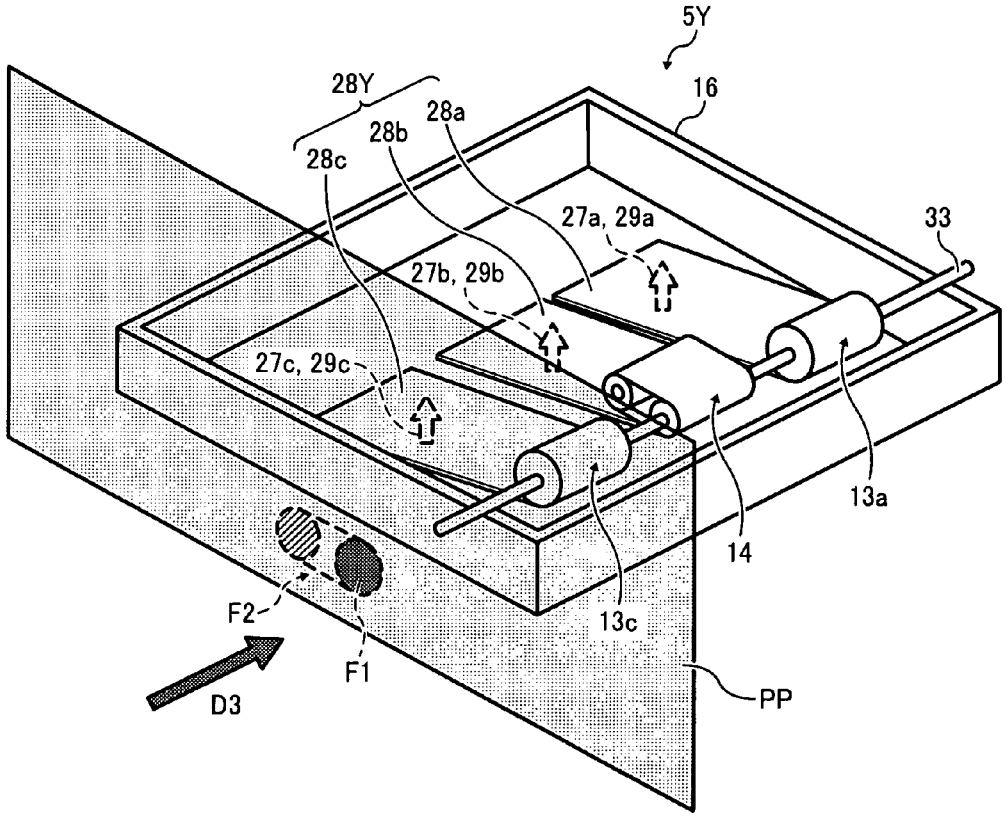
FIG. 12 is a perspective view of a sheet supplier according to yet another example embodiment.

FIG. 12 is a perspective view of a sheet supplier 5Y. The sheet supplier 5Y includes a bottom plate 28Y. The bottom plate 28Y includes friction bottom plates 28*a* and 28*c* and/or an electrostatic bottom plate 28*b*. The sheet supplier 5Y further includes a push-up member 27*a* or 29*a*, the push-up member 27*b* or 29*b*, and/or a push-up member 27*c* or 29*c*. The bottom plate 28Y replaces the bottom plate 28 depicted in FIG. 2. The other elements of the sheet supplier 5Y are equivalent to the elements of the sheet supplier 5 depicted in FIG. 2.

The bottom plate 28Y is divided into the friction bottom plates 28*a* and 28*c* and the electrostatic bottom plate 28*b*. The friction bottom plates 28*a* and 28*c* and the electrostatic bottom plate 28*b* apply push-up forces to push up the uppermost sheet 6*a*, respectively. Accordingly, the friction separators 13*a* and 13*c* and the electrostatic separator 14 are applied with different feeding pressures to feed the uppermost sheet 6*a*, respectively.

The push-up members 27*a* and 27*c* are equivalent to the push-up member 27*b* depicted in FIG. 6. The push-up members 29*a* and 29*c* are equivalent to the push-up member 29*b* depicted in FIG. 7.

The push-up member 27*a* or 29*a*, the push-up member 27*b* or 29*b*, and the push-up member 27*c* or 29*c* generate the different feeding pressures, respectively. For example, a spring may generate the feeding pressure. A solenoid may release the feeding pressure by pulling the spring. An eccentric cam may change or release the feeding pressure steplessly. When only the electrostatic separator 14 is used, the feeding pressure of the friction separators 13*a* and 13*c* may be released so that the friction separators 13*a* and 13*c* do not feed the uppermost sheet 6*a*.

In the friction separators 13*a* and 13*c* and the electrostatic separator 14, pressures (e.g., separation pressures) applied by the double feeding blockers 31*a*, 31*c*, and 31*b* to the feed rollers 34*a* and 34*c* and the belt 19 depicted in FIG. 3, respectively, are changed independently. When only the friction separators 13*a* and 13*c* are used, the pressure (e.g., the separation pressure) applied by the double feeding blocker 31*b* to the belt 19 is released. When only the electrostatic separator 14 is used, the pressures (e.g., the separation pressures) applied by the double feeding blockers 31*a* and 31*c* to the feed rollers 34*a* and 34*c*, respectively, are released so as not to generate unnecessary separation pressure.

The friction separators 13*a* and 13*c* may include the spring 55*b* and the eccentric cam 56*b* depicted in FIG. 9. For example, the spring 55*b* and the eccentric cam 56*b* may be provided for each of the double feeding blockers 31*a*, 31*b*, and 31*c* to change the pressures (e.g., the separation pressures) of the double feeding blockers 31*a*, 31*b*, and 31*c* independently. When the separation pressure is released in either the friction separators 13*a* and 13*c* or the electrostatic separator 14, the feeding pressure of the corresponding friction separators 13*a* and 13*c* or the corresponding electrostatic separator 14 may be released to improve performance of the friction separators 13*a* and 13*c* and the electrostatic separator 14.

As illustrated in FIG. 12, the push-up member 27*b* or 29*b*, serving as a second pressing member, pushes up the friction bottom plate 28*b* so that the plurality of sheets 6 placed on the bottom plate 28Y in the paper tray 16 is pressed against the electrostatic separator 14. Similarly, the push-up members 27*a* and 27*c* or the push-up members 29*a* and 29*c*, serving as a first pressing member, push up the friction bottom plates 28*a* and 28*c*, respectively, so that the plurality of sheets 6 placed on the bottom plate 28Y in the paper tray 16 is pressed against the friction separators 13*a* and 13*c*. The push-up members 27*a* and 27*c* (or the push-up members 29*a* and 29*c*) and the push-up member 27*b* or 29*b* apply different pressures to the bottom plate 28Y, respectively.

With the above-described structure, the push-up members 27*a*, 27*b*, and 27*c* (or the push-up members 29*a*, 29*b*, and 29*c*) apply proper pressures to the friction separator 13*a*, the electrostatic separator 14, and the friction separator 13*c*, respectively. Accordingly, the friction separators 13*a* and 13*c* and the electrostatic separator 14 separate the uppermost sheet 6*a* from other sheets 6 and feed the separated uppermost sheet 6*a* stably.

Referring to FIG. 3, the following describes operations of the sheet supplier 5 depicted in FIG. 2, the sheet supplier 5X depicted in FIG. 7, or the sheet supplier 5Y depicted in FIG. 12.

When the driving shaft 33 connected to the driver rotates, the feed rollers 34*a* and 34*c* of the friction separators 13*a* and 13*c*, respectively, and the driving roller 17 of the electrostatic separator 14 or the electrostatic separator 14X depicted in FIG. 11 rotate. In the friction separators 13*a* and 13*c*, a friction force generated between the uppermost sheet 6*a* and the feed rollers 34*a* and 34*c* moves (e.g., feeds) the uppermost sheet 6*a* in the sheet conveyance direction D1. In the electrostatic separator 14 or 14X, the belt 19 attracts the uppermost sheet 6*a* and moves (e.g., feeds) the uppermost sheet 6*a* in the sheet conveyance direction b1. The double feeding blockers 31*a*, 31*b*, and 31*c* restrict movement of the second sheet 6*b* and the sheets 6 under the second sheet 6*b* so that the friction separators 13*a* and 13*c* and the electrostatic separator 14 or 14X do not feed the second sheet 6*b* and the sheets 6 under the second sheet 6*b* together with the uppermost sheet 6*a*. Accordingly, only the uppermost sheet 6*a* is conveyed to the conveyance roller pair 8 depicted in FIG. 1.

As described above, in the sheet supplier 5, 5X, or 5Y, the sheet separator 7 includes the friction separators 13*a* and 13*c*, the electrostatic separator 14 or 14X, and the conveyance roller pair 8 depicted in FIG. 1. The friction separators 13*a* and 13*c* separate the uppermost sheet 6*a* from other sheets 6 loaded on the paper tray 16 depicted in FIG. 2 by a friction force. The electrostatic separator 14 or 14X separates the uppermost sheet 6*a* from other sheets 6 loaded on the paper tray 16 by an attraction force generated by a non-uniform electric field. The conveyance roller pair 8 is provided downstream from the friction separators 13*a* and 13*c* and the electrostatic separator 14 or 14X in the sheet conveyance direction D1. The conveyance roller pair 8 conveys the uppermost sheet 6*a* separated by at least one of the friction separators 13*a* and 13*c* and the electrostatic separator 14 or 14X. The friction separators 13*a* and 13*c* and the electrostatic separator 14 or 14X are arranged in such a manner that the planes of projection of the friction separators 13*a* and 13*c* and the electrostatic separator 14 or 14X overlap or coincide in the direction perpendicular to the sheet conveyance direction D1 in which the conveyance roller pair 8 conveys the uppermost sheet 6*a*.

Such arrangement of the friction separators 13*a* and 13*c* and the electrostatic separator 14 or 14X which separate the uppermost sheet 6*a* from other sheets 6 by the different forces (e.g., the friction force and the attraction force), respectively, causes the friction separators 13*a* and 13*c* and the electrostatic separator 14 or 14X to operate on the uppermost sheet 6*a* simultaneously. Accordingly, under a condition (e.g., an environmental condition and sheet type) in which the uppermost sheet 6*a* is not separated from other sheets 6 precisely by the friction separators 13*a* and 13*c* only, the electrostatic separator 14 or 14X separates the uppermost sheet 6*a* from other sheets 6 mainly. By contrast, under a condition (e.g., an environmental condition and sheet type) in which the uppermost sheet 6*a* is not separated from other sheets 6 precisely by the electrostatic separator 14 or 14X only, the friction separators 13*a* and 13*c* separate the uppermost sheet 6*a* from other sheets 6 mainly. Thus, the friction separators 13*a* and 13*c* and the electrostatic separator 14 or 14X can separate the uppermost sheet 6*a* from other sheets 6 precisely by redeeming the drawbacks (e.g., difficult conditions) of the friction separators 13*a* and 13*c* and the electrostatic separator 14 or 14X each other. Consequently, the sheet supplier 5, 5X, or 5Y can perform separation operations stably with various types of sheet even when the environmental condition changes over time.

The friction separators 13*a* and 13*c* and the electrostatic separator 14 or 14X are arranged in such a manner that the planes of projection of the friction separators 13*a* and 13*c* and the electrostatic separator 14 or 14X overlap or coincide in the direction perpendicular to the sheet conveyance direction D1 in which the conveyance roller pair 8 conveys the uppermost sheet 6*a*. In other words, positions of the friction separators 13*a* and 13*c* and the electrostatic separator 14 or 14X with respect to the conveyance roller pair 8 are equivalent to positions of friction separators with respect to the conveyance roller pair 8 in conventional sheet suppliers not including an electrostatic separator. Further, both the friction separators 13*a* and 13*c* and the electrostatic separator 14 or 14X are provided in the sheet supplier 5, 5X, or 5Y, resulting in the compact sheet supplier 5, 5X, or 5Y.

As illustrated in FIG. 9, in the sheet supplier 5, 5X, or 5Y, the electrostatic separator 14 includes the belt 19, the double feeding blocker 31*b*, the spring 55*b*, and the eccentric cam 56*b*. The belt 19 attracts the uppermost sheet 6*a* of the plurality of sheets 6 loaded on the paper tray 16 depicted in FIG. 2 and feeds the attracted uppermost sheet 6*a*. The double feeding blocker 31*b* prevents sheets 6 other than the uppermost sheet 6*a* from being fed by the belt 19. The spring 55*b* applies pressure to the double feeding blocker 31*b* to press the double feeding blocker 31*b* against the belt 19. The eccentric cam 56*b* changes the pressure applied by the spring 55*b*.

With the above-described structure, even when an attraction force of the belt 19 acts on sheets 6 other than the uppermost sheet 6*a* loaded on the paper tray 16, the double feeding blocker 31*b* prevents double feeding. In other words, the double feeding blocker 31*b* prevents the sheets 6 other than the uppermost sheet 6*a* from being fed by the belt 19. Accordingly, the belt 19 feeds the uppermost sheet 6*a* before the attraction force of the belt 19 acting on the sheets 6 other than the uppermost sheet 6*a* dissipates. Consequently, the electrostatic separator 14 can separate the uppermost sheet 6*a* from other sheets 6 and feed the separated uppermost sheet 6*a* quickly.

The image forming apparatus 1 depicted in FIG. 1 includes the sheet supplier 5, 5X, or 5Y. Thus, even when various types of sheet is used in the image forming apparatus 1, the sheet supplier 5, 5X, or 5Y can separate the uppermost sheet 6*a* from other sheets 6 stably under various environmental conditions changing over time.

As described above, a sheet supplier (e.g., the sheet supplier 5, 5X, or 5Y) includes a sheet tray (e.g., the paper tray 16 depicted in FIG. 2) and a sheet separator (e.g., the sheet separator 7 depicted in FIG. 2). The sheet separator includes a friction separator (e.g., the friction separators 13*a* and 13*c* depicted in FIG. 2), an electrostatic separator (e.g., the electrostatic separator 14 depicted in FIG. 2 or the electrostatic separator 14X depicted in FIG. 11), and a conveyance member (e.g., the conveyance roller pair 8 depicted in FIG. 1).

The sheet tray loads a plurality of sheets. The sheet separator separates an uppermost sheet from other sheets of the plurality of sheets loaded on the sheet tray, and feeds the separated uppermost sheet. The friction separator separates the uppermost sheet from other sheets of the plurality of sheets loaded on the sheet tray by a friction force. The electrostatic separator separates the uppermost sheet from other sheets of the plurality of sheets loaded on the sheet tray by an attraction force generated by a non-uniform electric field. The conveyance member is provided downstream from the friction separator and the electrostatic separator in a sheet conveyance direction, and feeds the uppermost sheet separated by at least one of the friction separator and the electrostatic separator in the sheet conveyance direction. The friction separator and the electrostatic separator are arranged in such a manner that planes of projection of the friction separator and the electrostatic separator overlap or coincide in a direction perpendicular to the sheet conveyance direction in which the conveyance member feeds the uppermost sheet.

With the above-described structure, such arrangement of the friction separator and the electrostatic separator which separate the uppermost sheet by the different forces (e.g., the friction force and the attraction force), respectively, causes the friction separator and the electrostatic separator to operate on the uppermost sheet simultaneously. Thus, the friction separator and the electrostatic separator can separate the uppermost sheet from other sheets precisely by redeeming the drawbacks (e.g., difficult conditions) of the friction separator and the electrostatic separator each other. Consequently, the sheet supplier can perform separation operations stably with various types of sheet even when the environmental condition changes over time.

The friction separator and the electrostatic separator are arranged in such a manner that the planes of projection of the friction separator and the electrostatic separator overlap or coincide in the direction perpendicular to the sheet conveyance direction in which the conveyance member feeds the uppermost sheet. In other words, positions of the friction separator and the electrostatic separator with respect to the conveyance member are equivalent to positions of friction separators with respect to the conveyance member in conventional sheet suppliers not including an electrostatic separator. Further, both the friction separator and the electrostatic separator are provided in the sheet supplier, resulting in the compact sheet supplier.

As illustrated in FIG. 12, the friction separators 13*a* and 13*c* and the electrostatic separator 14 are arranged in such a manner that when seen from a direction D3, a cross-section (e.g., a FIG. F1) of each of the friction separators 13*a* and 13*c* projected on a projection plane PP overlaps or coincides with a cross-section (e.g., a FIG. F2) of the electrostatic separator 14 projected on the projection plane PP in the direction perpendicular to the sheet conveyance direction D1 in which the conveyance roller pair 8 conveys the uppermost sheet 6*a* and parallel to a sheet surface of the uppermost sheet 6*a*.

The sheet supplier further includes a first pressing member (e.g., the push-up members 27*a* and 27*c* or the push-up members 29*a* and 29*c* depicted in FIG. 12) and a second pressing member (e.g., the push-up member 27*b* or 29*b* depicted in FIG. 12). The first pressing member presses the plurality of sheets loaded on the sheet tray against the friction separator. The second pressing member presses the plurality of sheets loaded on the sheet tray against the electrostatic separator. The first pressing member and the second pressing member apply different pressures to the plurality of sheets, respectively.

With the above-described structure, the first pressing member and the second pressing member apply proper pressures to the friction separator and the electrostatic separator, respectively. Accordingly, the friction separator and the electrostatic separator separate the uppermost sheet from other sheets of the plurality of sheets loaded on the sheet tray and feed the separated uppermost sheet stably.

The electrostatic separator includes a belt (e.g., the belt 19 depicted in FIG. 9), a double feeding blocker (e.g., the double feeding blocker 31*b* depicted in FIG. 9), a pressure applier (e.g., the spring 55*b* depicted in FIG. 9), and a pressure adjuster (e.g., the eccentric cam 56*b* depicted in FIG. 9). The belt attracts and feeds the uppermost sheet of the plurality of sheets loaded on the sheet tray. The double, feeding blocker prevents a sheet of the plurality of sheets loaded on the sheet tray other than the uppermost sheet from being fed by the belt. The pressure applier applies pressure to the double feeding blocker to press the double feeding blocker against the belt. The pressure adjuster changes the pressure applied by the pressure applier.

With the above-described structure, even when the attraction force of the belt of the electrostatic separator acts on the sheet of the plurality of sheets other than the uppermost sheet, the double feeding blocker prevents double feeding of the sheets. Accordingly, the electrostatic separator feeds the uppermost sheet before the attraction force acting on the sheet of the plurality of sheets other than the uppermost sheet dissipates. In other words, time is not spent to wait until the attraction force acting on the sheet of the plurality of sheets other than the uppermost sheet dissipates. Consequently, the electrostatic separator separates the uppermost sheet from other sheets and feeds the separated uppermost sheet quickly.

An image forming apparatus (e.g., the image forming apparatus depicted in FIG. 1) includes the sheet supplier.

With the above-described structure, even when the image forming apparatus uses various types of sheet, the image forming apparatus including the sheet supplier separates the uppermost sheet from other sheets stably under environmental conditions changing over time.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A sheet supplier comprising:

a sheet tray to load a plurality of sheets; and a sheet separator to separate an uppermost sheet from the plurality of other sheets loaded on the sheet tray, and feed the separated uppermost sheet, the sheet separator comprising:

a friction separator to separate the uppermost sheet with a friction force;

an electrostatic separator to separate the uppermost sheet from the plurality of other sheets with an attraction force based on a non-uniform electric field; and a conveyance member provided downstream from the friction separator and the electrostatic separator in a sheet conveyance direction to feed the uppermost sheet separated, wherein the friction separator and the electrostatic separator are arranged in such a manner that a first figure of the friction separator projected in a projecting direction on a single plane overlaps or coincides with a second figure of the electrostatic separator projected in the projecting direction on the single plane, the projecting direction is perpendicular to the sheet conveyance direction and parallel to a sheet surface, and the single plane is perpendicular to the projecting direction, and wherein the friction separator and the electrostatic separator are configured to contact the uppermost sheet simultaneously while the uppermost sheet is in contact with the plurality of other sheets loaded on the sheet tray.

2. The sheet supplier according to claim 1, further comprising:

a first pressing member to press the plurality of sheets loaded on the sheet tray against the friction separator; and a second pressing member to press the plurality of sheets loaded on the sheet tray against the electrostatic separator, wherein the first pressing member and the second pressing member apply different pressures to the plurality of sheets, respectively.

3. The sheet supplier according to claim 1, wherein the electrostatic separator comprises:

a belt to attract and feed the uppermost sheet of the plurality of sheets loaded on the sheet tray;

a double feeding blocker to prevent a sheet of the plurality of sheets loaded on the sheet tray other than the uppermost sheet from being fed by the belt;

a pressure applier to apply pressure to the double feeding blocker to press the double feeding blocker against the belt; and a pressure adjuster to change the pressure applied by the pressure applier.

4. The sheet supplier according to claim 1, wherein at least one of the friction separator and the electrostatic separator is mounted on the sheet tray.

5. An image forming apparatus comprising:

a sheet supplier of the image forming apparatus comprising:

a sheet tray to load a plurality of sheets; and a sheet separator to separate an uppermost sheet from the plurality of other sheets loaded on the sheet tray, and feed the separated uppermost sheet, the sheet separator of the image forming apparatus comprising:

a friction separator to separate the uppermost sheet with a friction force;

an electrostatic separator to separate the uppermost sheet from the plurality of other sheets with an attraction force based on a non-uniform electric field; and a conveyance member provided downstream from the friction separator and the electrostatic separator in a sheet conveyance direction to feed the uppermost sheet separated, wherein the friction separator and the electrostatic separator are arranged in such a manner that a first figure of the friction separator projected in a projecting direction on a single plane overlaps or coincides with a second figure of the electrostatic separator projected in the projecting direction on the single plane, the projecting direction is perpendicular to the sheet conveyance direction and parallel to a sheet surface, and the single plane is perpendicular to the projecting direction, and wherein the friction separator and the electrostatic separator are configured to contact the uppermost sheet simultaneously while the uppermost sheet is in contact with the plurality of other sheets loaded on the sheet tray.

6. The image forming apparatus according to claim 5, wherein the sheet supplier further comprises:

a first pressing member to press the plurality of sheets loaded on the sheet tray against the friction separator; and a second pressing member to press the plurality of sheets loaded on the sheet tray against the electrostatic separator, wherein the first pressing member and the second pressing member apply different pressures to the plurality of sheets, respectively.

7. The image forming apparatus according to claim 5, wherein the electrostatic separator comprises:

a belt to attract and feed the uppermost sheet of the plurality of sheets loaded on the sheet tray;

a double feeding blocker to prevent a sheet of the plurality of sheets loaded on the sheet tray other than the uppermost sheet from being fed by the belt;

a pressure applier to apply pressure to the double feeding blocker to press the double feeding blocker against the belt; and a pressure adjuster to change the pressure applied by the pressure applier.

8. The image forming apparatus according to claim 4, wherein at least one of the friction separator and the electrostatic separator is mounted on the sheet tray.

* * * * *